US007407518B2

(12) United States Patent
Bosman et al.

(10) Patent No.: US 7,407,518 B2
(45) Date of Patent: Aug. 5, 2008

(54) METHOD FOR PRODUCTION OF SEAT BELT WEBBING

(75) Inventors: Rigobert Leon Maria Bosman, Landgraaf (NL); Andreas Doll, Aschaffenburg (DE); Marcel Johannes Josephus Wiegerinck, Emmen (NL)

(73) Assignee: Diolen Industrial Fibers GmbH, Wuppertal (DE)

( * ) Notice: Subject to any disclaimer, the term of this patent is extended or adjusted under 35 U.S.C. 154(b) by 249 days.

(21) Appl. No.: 10/511,324

(22) PCT Filed: Apr. 15, 2003

(86) PCT No.: PCT/EP03/03897

§ 371 (c)(1),
(2), (4) Date: Oct. 15, 2004

(87) PCT Pub. No.: WO03/091489

PCT Pub. Date: Nov. 6, 2003

(65) Prior Publication Data

US 2005/0150062 A1 Jul. 14, 2005

(30) Foreign Application Priority Data

Apr. 23, 2002 (DE) ..... 102 18 134

(51) Int. Cl.
*D06P 3/85* (2006.01)
*D06P 3/86* (2006.01)

(52) U.S. Cl. ..... 8/494; 8/481; 8/497; 297/468; 139/383 B

(58) Field of Classification Search ..... 8/636, 8/481, 494, 497; 297/468; 139/383 B
See application file for complete search history.

(56) References Cited

U.S. PATENT DOCUMENTS

| | | | | | |
|---|---|---|---|---|---|
| 3,414,957 | A | * | 12/1968 | Langstaff et al. | 28/156 |
| 3,926,227 | A | | 12/1975 | Takada et al. | |
| 4,473,617 | A | * | 9/1984 | van Leeuwen et al. | 428/373 |
| 4,800,117 | A | * | 1/1989 | Marshall | 442/187 |
| 5,436,044 | A | | 7/1995 | Pinkos | |
| 5,713,601 | A | | 2/1998 | Bonigk | |

FOREIGN PATENT DOCUMENTS

| | | | |
|---|---|---|---|
| DE | 29 02 905 | | 7/1980 |
| DE | 35 21 262 | | 12/1985 |
| DE | 195 37 700 | | 4/1997 |
| GB | 2040327 | * | 8/1980 |
| JP | 01306647 | * | 12/1989 |
| JP | 410140479 | * | 5/1998 |
| WO | WO 92 03603 | | 3/1992 |

* cited by examiner

*Primary Examiner*—Lorna M. Douyon
*Assistant Examiner*—Amina Khan
(74) *Attorney, Agent, or Firm*—Oliff & Berridge, PLC

(57) ABSTRACT

A method of producing seat belt webbing is proposed in which the webbing is first woven using at least two synthetic yarns of different colours of which at least one yarn is spun-dyed, and using weaves that are known per se, and that is distinguished in that the webbing is then subjected to treatment in a water-bath containing at least one disperse dye. Seat belt webbing produced in this way and seat belts containing such webbing are also claimed.

15 Claims, No Drawings

METHOD FOR PRODUCTION OF SEAT BELT WEBBING

BACKGROUND OF THE INVENTION

1. Field of Invention

The present invention relates to a method for production of seat belt webbing wherein the webbing is first woven using at least two synthetic yarns of different colors, of which at least one yarn is spun-dyed, and using weaves that are known per se. Furthermore, the invention is intended for seat belts containing such seat belt webbing.

2. Description of Related Art

A method of this type for production of seat belt webbing is known. DE-A-2902905, for example, describes a method for production of seat belt webbing patterned in bright colors for motor vehicles, aircraft, etc. in which the webbing is woven using at least two spun-dyed synthetic yarns of different colors, at least one yarn having a bright color, and using weaves that are known per se. The spun-dyed seat belt webbing of DE-A-2902905 is claimed to be distinguished by optimal color uniformity within the colors and patterns, optimal abrasion resistance, and resistance to heat and light. Furthermore, it is claimed to overcome the disadvantage of using yarn-dyed varieties or piece-dyed webbing, namely, the allegedly poor color-fastness of the dyes known at the time.

Seat belt webbing must satisfy stringent requirements in regard to usability, field of application and durability. In addition to having to meet strict specifications for abrasion resistance, resistance to light and heat, etc., seat belt webbing must be capable of being put in place and removed easily, and must always rest securely and comfortably on the wearer during use. Good retraction behavior of the seat belt webbing is particularly important for these last characteristics. In addition to a well adjusted retraction mechanism specially tailored to the specific application, the material properties of the webbing are particularly important here. Of these material properties, the surface of the webbing is of particular significance because its structure and properties decisively influence the retraction behavior.

Many attempts have been made to influence the surface properties of seat belt webbing in regard to retraction behavior. Particularly noteworthy in this respect is the thermofixing step, in which, following the weaving process, the yarns are for example subjected to hot-air treatment, resulting in a smoother surface of the webbing thus treated and therefore to improved retraction behavior.

Unfortunately, even these treatment steps have not proved to be effective in all cases. For example, the retraction behavior of seat belt webbing is not satisfactory precisely during use under extreme conditions such as very high, and particularly very low, temperatures. These problems are naturally most evident particularly when such seat belt webbing is being used after a lapse of time, for example when the seat belt is fastened in a vehicle that has been subjected to very high or low temperatures over a period of time. This is typically the case while starting in the morning following a cold night, or when the vehicle has been standing in strong sunlight for some time in the summer. The retraction behavior does normally improve subsequently under the influence of the heating or air-conditioning in the vehicle. However, this may not always be the case if, for example, the vehicle is driven for only a short time, or if suitable and effective air-conditioning equipment is not easily available.

SUMMARY OF THE INVENTION

The object of the present invention is therefore to provide a method of producing seat belt webbing in which the disadvantages of the prior art are at least reduced and by which good retraction behavior, particularly at very low temperatures, is obtained. Moreover, the other positive characteristics of the seat belt webbing such as color fastness, abrasion resistance, and resistance to heat and light should remain at at least the customarily high level.

Further advantages of the invention are described below.

DETAILED DESCRIPTION OF PREFERRED EMBODIMENTS

The object of the invention is achieved by the method described herein that is distinguished in that the webbing is subjected to treatment in a water-bath containing at least one disperse dye.

Entirely unexpectedly, this additional step results in seat belt webbing showing improved retraction behavior as compared with webbing produced by known methods. This advantage is manifested particularly at very low temperatures, such as those prevailing over long periods of time near the Arctic circle.

It has been shown in particular that the presence of disperse dyes in the baths plays a surprisingly important role. Treatment of the webbing with the bath liquid alone has almost no effect on the surface structure and therefore on the retraction behavior. The penetration of the disperse dyes into the surface presumably leads to smoothening that has a particularly advantageous effect on the retraction properties of webbing produced by this method.

It has been shown in particular that it is sufficient for the water-bath to contain only one disperse dye, which is especially preferred on technical and economic grounds. Treatment in a water-bath containing disperse dyes is known per se to those skilled in the art and is conveniently carried out at temperatures between 40 and 90° C. Disperse dyes are likewise well known to those skilled in the art. For the claimed method, the type of disperse dye is not critical, and any of the usual disperse dyes can be used without restriction.

It is moreover preferred for the method of the invention if the synthetic yarns are high-strength polyester yarns. In this case, particularly good surface characteristics can be obtained using disperse dyes. These materials also satisfy the high demands placed on safety belts in respect of breaking force.

In particular, these yarns are of polyethylene terephthalate with a breaking tenacity of 50 to 100 cN/tex, preferably of 60 to 90 cN/tex. The various yarns (undyed and spun-dyed) should possess a uniform level of hot-air shrinkage (after 15 min, at 190° C.) of between 8 and 22%, and preferably between 10 and 20%.

Preferably, the elongation at break of the yarns should be uniformly between 10 and 20%, and in particular between 14 and 17%.

Finally, the linear density of the synthetic yarns should be between 100 and 3000 dtex, and preferably between 550 and 1800 dtex, the filament linear density being between 5 and 30 dtex but preferably between 8 and 20 dtex.

It is moreover preferred that the method of the present invention comprise the thermofixing step known per se, which results in the retention of the advantageous properties of the seat belt webbing obtained.

The invention is further directed towards seat belt webbing that can be produced or obtained by the method of the invention. Seat belt webbing of this type shows as a result of its production process the advantageous properties described above and, in particular, the improved wind-up or retraction behavior.

Finally, seat belts manufactured from the seat belt webbing produced by the method of the invention are claimed for use in vehicles, aircraft, etc.

As has been described above, the method of the invention also allows the production of seat belt webbing in a large variety of colors and patterns obtained, for example, through different weaves and/or different color sequences. Weaves are the various types of crossing of warp and weft threads known in weaving technology, as exemplified by the systematically constructed basic weaves: plain, twill and satin. Such weaves are known per se to those skilled in the art. It is preferred here if at least one of the spun-dyed yarns used in weaving the seat belt webbing has a bright color, such as yellow, because an even greater variety of colors and patterns is obtained by this means.

The use of spun-dyed and undyed synthetic yarns for seat belt webbing, combined with weaving techniques that are known per se and with the process step of treatment in a water-bath containing disperse dyes, results in various color sequences, hues and patterns being obtained. Appropriate combinations of various spun-dyed and undyed yarns, weaves and disperse dyes allow—as an additional advantage, so to speak—any required combination of colors and patterns to be used in the seat belt webbing obtained.

The method of the invention thus not only provides seat belt webbing with improved retraction properties, but also allows production of visually attractive fabrics in a large variety of patterns and shades.

The invention will be described in more detail with the help of the non-restrictive example below.

Seat belt webbing was woven from untwisted polyethylene terephthalate yarns with a yarn count of 1670f105. Part of the yarns were undyed and part spun-dyed using the yellow pigment dye Rowasol FL-31180, which had been added to the melt. After weaving, the seat belt webbing consisted of undyed and yellow sections. The webbing so obtained was then treated in a water bath containing a blue disperse dye (Polysynthren Blue RBL=Blue 104 from Clariant) at 50° C. and then thermofixed with hot air at about 180° C.

A seat belt was produced from this seat belt webbing and installed in a car. This car was maintained in a cold chamber at −20° C. for 12 hours and the retraction behavior was compared with that of another seat belt, installed in the same vehicle and produced in the same way as described above except that the water-bath contained no disperse dye.

Each of the belts was extended and released 100 times. It was found that complete retraction of the seat belt produced by the method of the invention occurred with a significantly higher frequency than for the comparison belt.

The invention claimed is:

1. A method for production of a seat belt consisting of forming a seat belt webbing by weaving at least two synthetic yarns of different colors, wherein at least one yarn is spun-dyed, subsequently subjecting the seat belt webbing to treatment in a water-bath containing at least one disperse dye, and forming a seat belt from the seat belt webbing.

2. Method according to claim 1, wherein the water-bath contains only one disperse dye.

3. Method according to claim 1, wherein the synthetic yarns are polyester yarns having a breaking tenacity of 50 to 100 cN/tex.

4. Method according to claim 3, wherein the polyester yarns consist of polyethylene terephthalate.

5. Method according to claim 3, wherein the polyester yarns have a hot-air shrinkage (15 min, 190° C.) of 8 to 22%.

6. Method according to claim 3, wherein the polyester yarns have an elongation at break of 10 to 20%.

7. Method according to claim 1, wherein the synthetic yarns have a linear density of between 100 and 3000 dtex, the filament linear density being between 5 and 30 dtex.

8. Method according to claim 1, wherein at least one of the spun-dyed yarns has a bright color.

9. Method according to claim 3, wherein the polyester yarns consist of polyethylene terephthalate and have a breaking tenacity of 60 to 90 cN/tex.

10. Method according to claim 3, wherein the polyester yarns have a hot-air shrinkage (15 min, 190° C.) of 10 to 20%.

11. Method according to claim 3, wherein the polyester yarns have an elongation at break of 14 to 17%.

12. Method according to claim 1, wherein the synthetic yarns have a linear density between 550 and 1800 dtex.

13. Method according to claim 1, wherein the synthetic yarns have a filament linear density between 8 and 20 dtex.

14. A method for production of a seat belt consisting of forming a seat belt webbing by weaving at least two synthetic yarns of different colors, wherein at least one yarn is spun-dyed, subsequently subjecting the seat belt webbing to treatment in a water-bath containing at least one disperse dye, subjecting the treated seat belt webbing to a thermofixing step, and forming a seat belt from the seat belt webbing.

15. Method according to claim 1, wherein the at least one disperse dye penetrates a surface of the seat belt webbing to improve retraction behavior of the seat belt.

* * * * *